United States Patent [19]

Stewart

[11] 4,312,002

[45] Jan. 19, 1982

[54] COMBINED RADAR AND INFRARED SCANNING ANTENNA

[75] Inventor: Douglas E. Stewart, Frimley Green, England

[73] Assignee: Marconi Company Limited, England

[21] Appl. No.: 169,604

[22] Filed: Jul. 17, 1980

Related U.S. Application Data

[63] Continuation of Ser. No. 940,565, Sep. 8, 1978, abandoned.

[30] Foreign Application Priority Data

Sep. 13, 1977 [GB] United Kingdom ..... 38126/77

[51] Int. Cl.[3] ..... H01Q 21/28; H01Q 19/18

[52] U.S. Cl. ..... 343/725; 343/761; 343/781 P; 343/872

[58] Field of Search ..... 343/725, 761, 781 P, 343/781 CA, 837, 839, 872, 6 ND

[56] References Cited

U.S. PATENT DOCUMENTS 2,645,769 7/1953 Roberts ..... 343/781
2,867,801 1/1959 Mariner et al. ..... 343/756

FOREIGN PATENT DOCUMENTS 1064614 4/1967 Fed. Rep. of Germany ... 343/781 P

*Primary Examiner*—Eli Lieberman
*Attorney, Agent, or Firm*—Kirschstein, Kirschstein, Ottinger & Cobrin

[57] ABSTRACT

An antenna system has a parabolic reflector mounted so that it points generally downwards and a primary aerial is located at the focus of that reflector. Waves from the primary aerial are reflected back by the parabolic reflector to a reflector plate through an aperture in which the primary aerial projects. Scanning in both elevation and azimuth is effected by movement of the reflector plate.

2 Claims, 5 Drawing Figures

COMBINED RADAR AND INFRARED SCANNING ANTENNA

This is a continuation of application Ser. No. 940,565, filed Sept. 8, 1978, now abandoned.

This invention relates to systems for the transmission and/or reception of electromagnetic waves and is more particularly, but not exclusively, concerned with antenna systems for ground-based radar equipment.

In antenna systems for ground-based surveillance radars where continuous all-round scanning is required, it is usual either for part of the radio apparatus (e.g. the radio frequency generator) to be mounted on the antenna array so as to be movable therewith or for the radio apparatus to be coupled to the array by way of rotating choke joints. However for tracking radars, somewhat different considerations apply. Firstly the desirable fast response of such a radar requires the inertia of moving parts of the antenna system to be kept low. Secondly the radio frequency losses of rotating joints (at the higher frequencies common to tracking radars with a view to reducing the size of the antenna system for a given resolution) militate against the use of such joints.

One object of the present invention is to provide a novel configuration of antenna system in which the conflicting requirements discussed above are satisfied so that it can be used for either surveillance or tracking.

Another object of the invention is to provide an improved construction of antenna system.

Yet another object of the invention is to provide an antenna system having improved provision for controlling its direction of radiation.

According to the present invention, an antenna system for a ground-based radar equipment has a parabolic reflector mounted so that it points generally downwards, a primary aerial located at the focus of the parabolic reflector and a reflector plate mounted to lie opposite the parabolic reflector with an aperture through which projects the primary aerial (or associated aerial feeder) or through which radio waves may pass between the primary aerial and the parabolic refelctor, the arrangement being such that, if the aerial system is used for transmitting, radio waves from the primary aerial are reflected back to the reflector plate by the parabolic reflector and the direction of radiation from the antenna system is controlled by varying the position of the reflector plate which is capable of being rotated about the geometric axis of the parabolic reflector to vary said direction in azimuth and being tilted to vary said direction in elevation. Although described here in the context of use for transmitting radio waves, it is to be understood that an antenna system in accordance with the invention may equally be used for receiving radio waves.

Preferably at least the primary aerial and reflector plate are contained within a radome housing and the parabolic reflector may conveniently form the roof of this housing.

Figure 1:
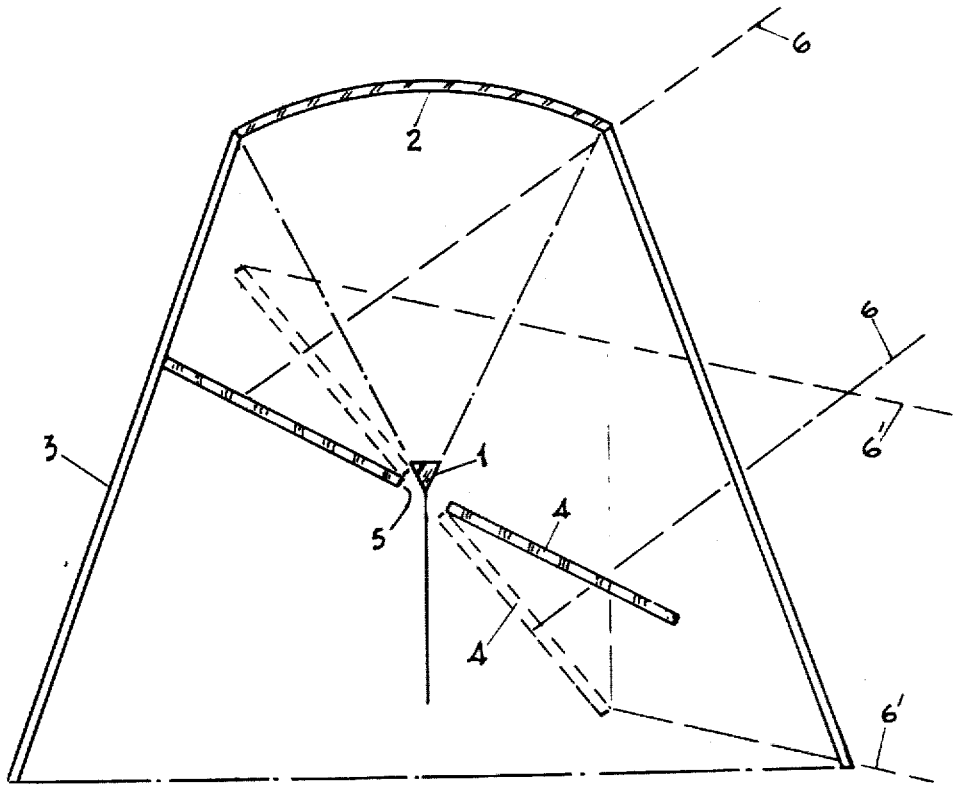
Figure 2:
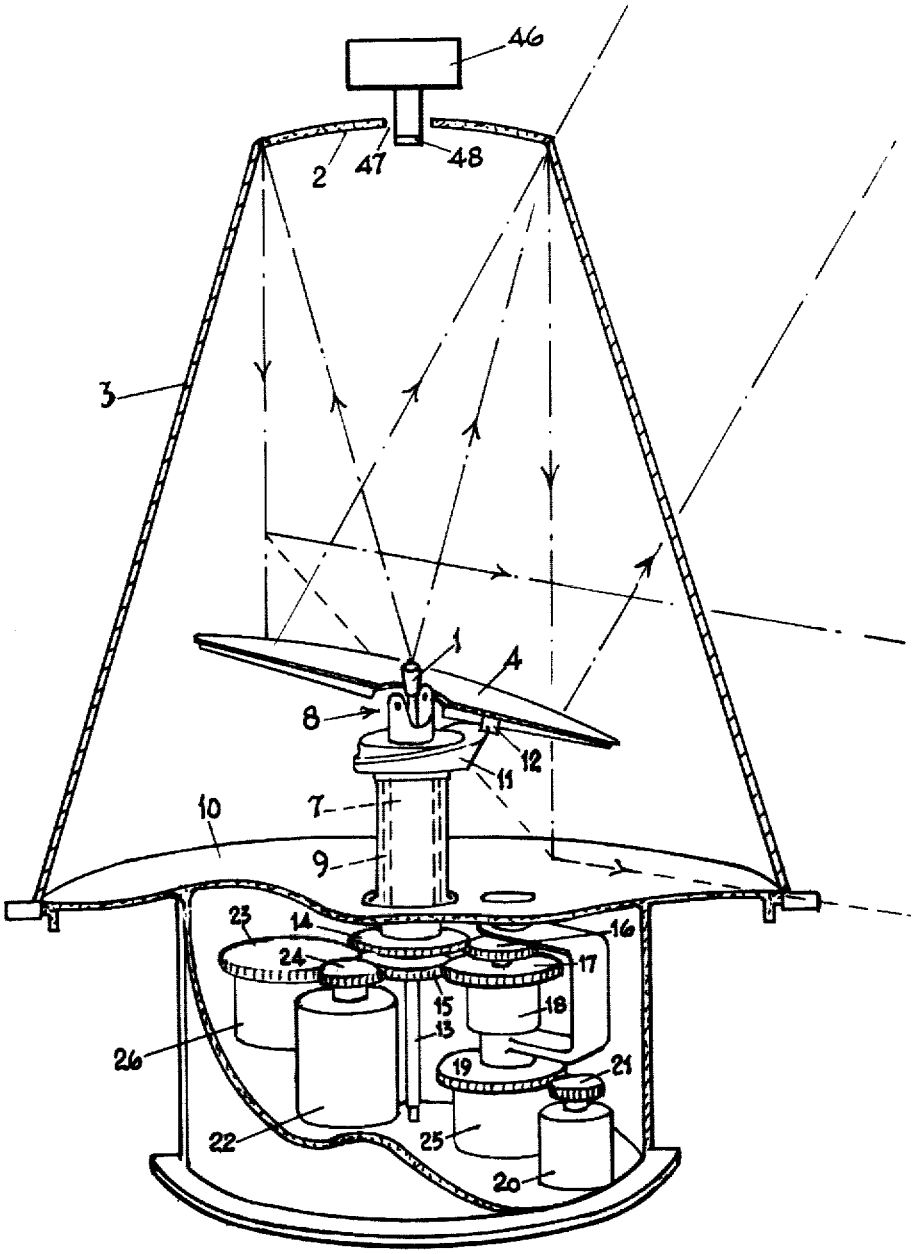
Figure 3:
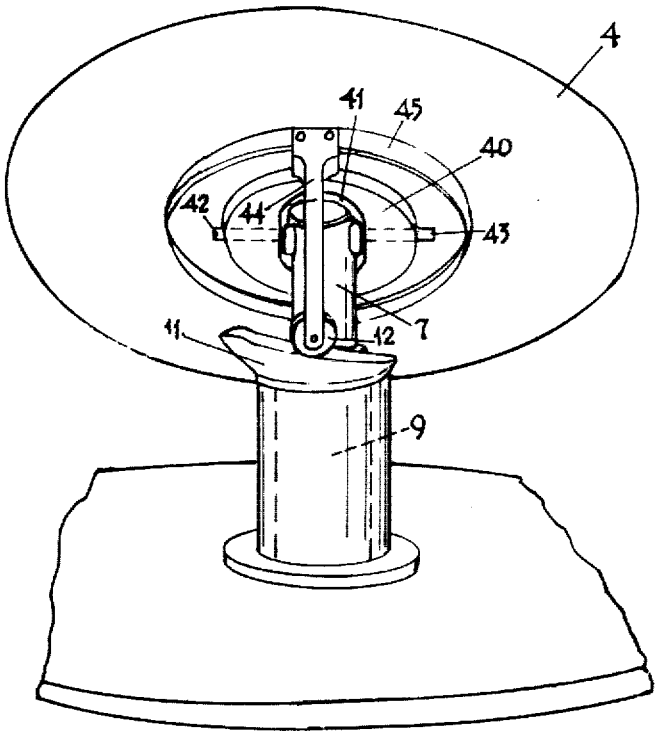
Figure 4:
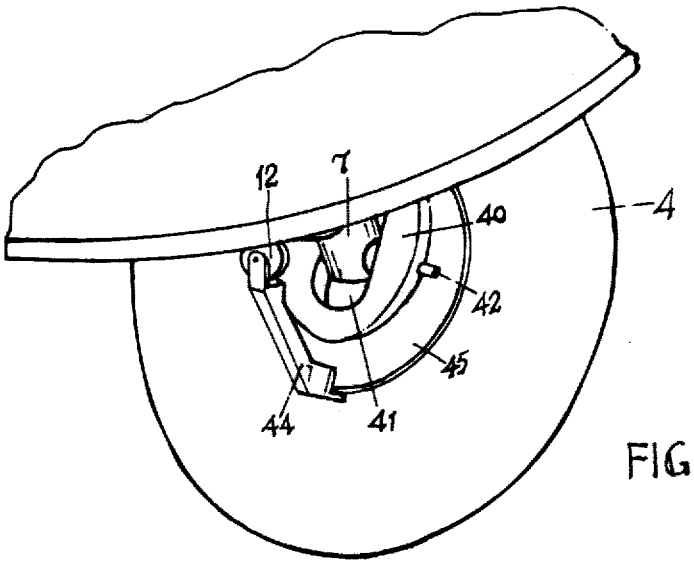
Figure 5:
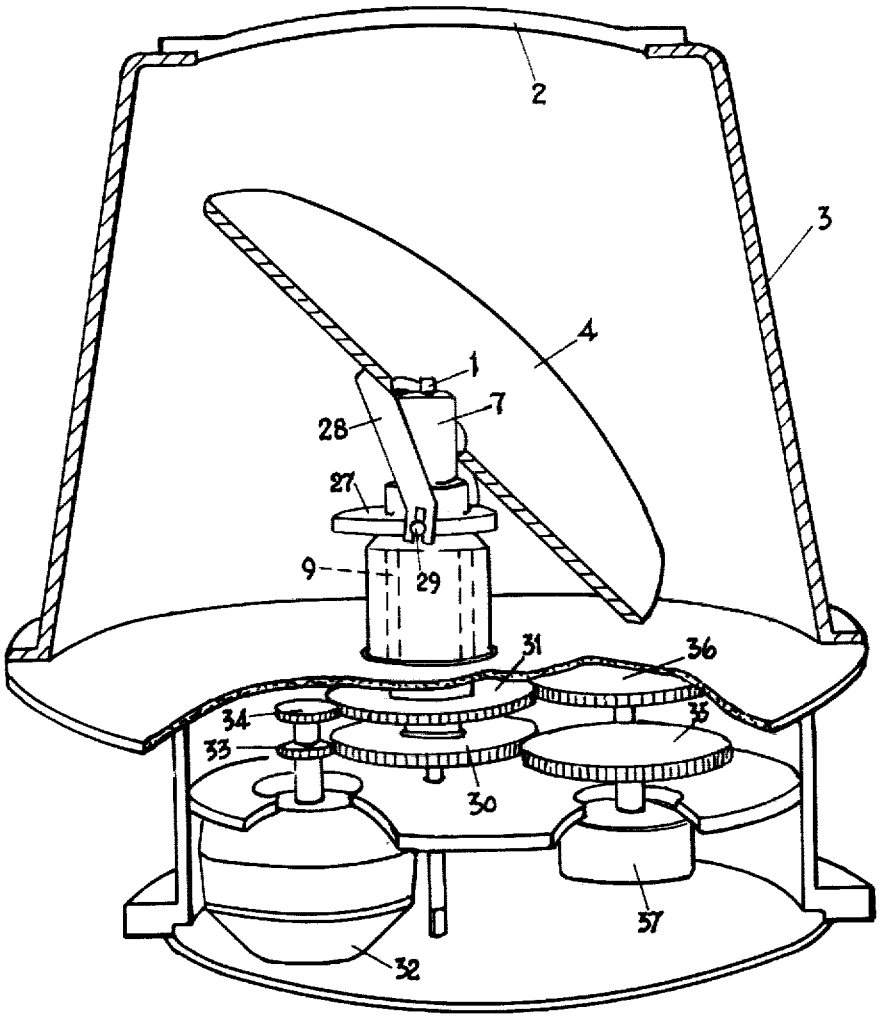

Two constructions of antenna systems in accordance with the invention will now be described by way of example with reference to the accompanying drawings in which FIG. 1 shows diagrammatically the basic elements and configuration of both systems, FIG. 2 is a partially sectioned perspective view showing diagrammatically the construction of one of the antenna systems for use in surveillance and tracking, FIGS. 3 and 4 are perspective views showing the construction of part of the antenna system of FIG. 2 in more detail, FIGS. 3 and 4 being respectively views from one side and from underneath, and FIG. 5 is a partially sectioned perspective view showing diagrammatically the construction of the other antenna system.

For convenience, the following description will refer to the antenna systems operating in the transmitting mode although it is to be understood that they would normally be used for both transmitting and receiving.

Referring now to FIG. 1 of the accompanying drawings, a primary aerial in the form of a waveguide horn 1 is arranged to radiate vertically upwards and immediately above the horn 1 there is a downward facing parabolic reflector 2, the horn 1 lying at the focus of the reflector 2. The reflector 2 is mounted at the top of a conical radome 3 so as to be coaxial therewith. The collimated beam reflected from the reflector 2 illuminates a flat reflector plate 4 having a central hole 5 through which the horn 1 projects. The radio waves reflected by the reflector plate 4 pass through the radome 3 and the emergent beam is defined by the pair of broken lines 6. For the purpose of varying the elevation of the beam, the angle of tilt of the reflector plate 4 is arranged to be varied between the position shown in the drawing and the position shown by the broken outline 4'. When the plate 4 is on the position 4', the emergent beam is defined by the broken lines 6'.

By rotating the plate 4 about the geometric axis of the parabolic reflector 2 (on which axis lies the horn 1), the azimuth direction of the emergent beam can be swept through 360°. The provisions for doing this are not shown in FIG. 1.

In the construction of antenna system now to be described with reference to FIG. 2 of the accompanying drawings, the reflector plate 4 is mounted on the end of a tube 7 by means of a hinge or pivot 8 (which is shown somewhat diagrammatically in this figure). The tube 7 is mounted via bearings (not shown) in another tube 9 which in turn is mounted via bearings (also not shown) on a support platform 10. The platform 10 also locates and supports the conical radome 3 which carries the parabolic reflector 2. A waveguide feeder 13 passes through the tubes 7 and 9 and is terminated at its upper end by the horn aerial 1.

At its upper end, the tube 9 is secured to a cam 11 and a cam follower 12 is secured to the back of the reflector plate 4, the cam follower may be urged into contact with the cam 11 by means of a spring (not shown). The angle of tilt of the reflector plate 4 and thus the elevation of the beam of radio waves transmitted by the aerial system may be changed by rotation of the tube 9. By rotating the tube 7 and 9 together the azimuth of the beam may be changed.

The mechanism described in the last two paragraphs is shown in more detail in FIGS. 3 and 4 of the accompanying drawings. Referring now also to those two figures, an annular member 40 is secured to the under side of the reflector plate 4 and the member 40 has an elongated aperture 41 into which extends the upper end of the tube 7. The plate 4 is pivotally mounted on the tube 7 by means of two stub shafts 42 and 43 which are secured to the tube 7 and which pass through the member 40. The cam 11 carried by the tube 9 engages a wheel which constitutes the cam follower 12. The cam follower wheel 12 is mounted on an arm 44 which is secured to an annular flange 45 projecting from the underside of the reflector plate 4.

Reverting now to FIG. 2, the tubes 7 and 9 are secured at their lower ends to gear wheels 15 and 14 respectively. A pair of co-axial gear wheels 16 and 17 mesh respectively with the gear wheels 14 and 15, and a differential gear unit 18 is connected between the gear wheels 16 and 17 are another gear wheel 19. Elevation drive is effected by means of an electric motor 20 via a gear wheel 21 which meshes with the gear wheel 19. When the aerial system is not being steered in azimuth, the gear wheels 15 and 17 are stationary so that operation of the motor 20 causes the tube 9 to rotate via gear wheels 21 and 19, the differential gear unit 18 and gear wheels 16 and 14.

Azimuth drive is effected by means of an electric motor 22, a gear wheel 24 which is coupled to the motor 22 meshing with the gear wheel 15. When the elevation of the radiated beam is not being changed, the gear wheel 19 is stationary so that operation of the motor 22 not only rotates the gear wheel 15 but also, via the differential gear unit 18, rotates the gear wheel 16 and thus the gear wheel 14, the gearing being such that the gear wheels 14 and 15 rotate at the same speed and in the same direction.

Two units 25 and 26 are coupled to the gear wheels 19 and 23 respectively and are arranged to supply electric signals (preferably in digital form) characterising the angle of tilt and position of the reflector plate 4. These signals represent the direction of the beam radiated by the aerial system in elevation and azimuth, it being remembered that the angle of tilt of the reflector plate 4 is one half the elevation angle.

Instead of the mechanism described above for controlling the tubes 7 and 9, the motors 20 and 22 may be arranged directly to drive the tubes 9 and 7 respectively through suitable gearing, that is to say without the provision of the differential gear unit 18. In this case, electric circuitry may be provided to supply operating signals to the motors 20 and 22 in response to signals representing the required demand in terms of elevation and azimuth, this circuitry performing electrically a function similar to that of the differential gear unit 18.

The form of drive described in the last paragraph can be simplified, to utilise only a single drive motor, if the antenna system is for use with a surveillance radar where a fixed search pattern is required in elevation and azimuth. The construction of antenna system now to be described with reference to FIG. 5 of the accompanying drawings is such an arrangement.

Referring to FIG. 5, the second construction of antenna system again comprises a primary aerial 1, a parabolic reflector 2, a conical radome 3, and a reflector plate 4. As in the previous example, the reflector plate 4 is carried by and pivoted to a tube 7, the pivot support for the plate 4 having been omitted from FIG. 3 for clarity, and the angle of tilt of the plate 4 is controlled by a tube 9. In this case a yoke member 27 is provided secured to the outer track of an eccentric bearing (not shown) which is carried on the tube 7 and is connected to the tube 9 while a stirrup 28 is fixed to the reflector plate 4 and engages a pair of lugs 29 (only one of which can be seen in FIG. 5) projecting from the member 27. Thus rotation of the tube 9 causes the lugs 29 to move in the horizontal plane (i.e. in a direction at right angles to the axis of rotation of the tube 9) so as to effect the desired change in the angle of tilt of the reflector plate 4.

Gear wheels 30 and 31 are secured respectively to the lower ends of the tubes 7 and 9. Drive to both the tubes 7 and 9 is provided by an electric motor 32 via gear wheels 33 and 34 which mesh with the gear wheels 30 and 31. The gear ratios are selected so that, upon operation of the motor 32, the tubes 7 and 9 rotate at different speeds so that the antenna system affects a continuous spiral scan.

The gear wheels 30 and 31 mesh with two further gear wheels 35 and 36 to which are respectively coupled a unit 37 and a similar unit (not shown) which are arranged to supply electric signal characterising the direction of the radiated beam in elevation and azimuth.

Although the primary aerial in each of the above examples consists of only a single aerial element, it is to be understood that an antenna system in accordance with the present invention is not so restricted and may have a plurality of aerial elements. One well known form of antenna system to which the invention is applicable is for use with a mono-pulse radar equipment, the primary aerial in this case consisting typically of four separate waveguide horns which all radiate together when the equipment is operating in its transmitting mode while the signals picked up by the individual horns in the receiving mode are subjected to differential interpretation to give the position of a body detected by the radar equipment.

The invention may also be applied to infra-red systems. In that case, the primary aerial 1 may be replaced by an infra-red detector and it is, of course, then necessary for the parabolic reflector 2 and the reflector plate 4 to have good optical reflecting properties.

In addition to transmitting or receiving a primary beam of radiation as previously considered herein, an antenna system in accordance with the present invention may have provision for a secondary beam which is colinear with the primary beam for all directions of the primary beam. The secondary beam may be of radio or infra-red waves. FIG. 2 of the accompanying drawings shows, by way of example, the modification necessary to provide such a secondary beam.

Referring now again to FIG. 2 of the accompanying drawings, the parabolic reflector 2 has a central aperture 47 through which pass waves between a unit 46 and the reflector plate 4, the unit 46 being either a source of radio waves, e.g. a radio transmitter with an associated aerial, (assuming the secondary beam is transmitted by the antenna system) or an infra-red receiver (if the antenna system is arranged to receive an infra-red secondary beam). The unit 46 points downwards as far as transmitted or received waves are concerned and has its own focussing arrangement 48, for example a lens system in the infra-red case. Radiation emitted by (or received by) the unit 47 is reflected by the reflector plate 4 into (or from) "free space" to form the secondary beam, the material of the radome 3 being such that it passes waves of the secondary beam. The arrangement ensures that the primary and secondary beams remain colinear upon movement of the reflector plate 4.

I claim:

1. An antenna system for ground-based radar equipment, comprising:

(a) a parabolic reflector facing vertically downwards, (b) a reflector plate mounted underneath said parabolic reflector and facing generally upwards, (c) a primary aerial element located at the focus of said parabolic reflector and directed towards it for the transmission and/or reception of a primary beam of radio waves, said primary beam being reflected by said parabolic reflector and by said reflector plate, (d) a secondary, infrared, receiver element mounted on the axis of said parabolic reflector and directed toward said plate reflector for the reception of a secondary, infrared, beam, said secondary beam being reflected by said reflector plate only, (e) mounting means for supporting said reflector plate at a variable angle with respect to the geometric axis of the parabolic reflector, (f) said primary and secondary beams being steered in unison by movement of said reflector plate mounting means, (g) said mounting means comprising a first member which is mounted for rotation about the geometric axis of the parabolic reflector, said first member pivotally supporting said reflector plate at said variable angle, a second member which is mounted for rotation about said geometric axis, and a mechanical coupling between the reflector plate and the second member, said mechanical coupling comprising one coupling member consisting of a cam follower and another coupling member consisting of a cam, one of said coupling members being secured to the reflector plate and the other coupling member being secured to the said second member, the cam follower bearing against the cam so that said variable angle is dependent upon the angular displacement about said geometric axis of the second member relative to the first member, (h) said mounting means permitting movement of said primary and secondary beams through 360° in azimuth and 180° in elevation, and (i) an all-round radome housing embracing the primary aerial element and the reflector plate and permitting the transmission of electromagnetic radiation therethrough at all angles of azimuth.

2. An antenna system according to claim 1 wherein the antenna drive means comprises a differential gear having three drive shafts, an azimuth drive motor coupled to a first drive shaft and to said first member, and an elevation drive motor coupled to a third drive shaft, said second member being coupled to a second drive shaft, operation of said elevation drive motor causing operation of said second drive shaft against the static first drive shaft and consequent rotation of said second member, and operation of said azimuth drive motor causing rotation of said first member, operation of said second drive shaft against the static third drive shaft, and consequent rotation of said second member in unison with said first member.

* * * * *